US007424758B2

(12) United States Patent
Broadley et al.

(10) Patent No.: US 7,424,758 B2
(45) Date of Patent: Sep. 16, 2008

(54) ROLL-IN COT

(75) Inventors: Gavin Lee Broadley, Coolum Beach (AU); Alan Raymond Cambridge, Brisbane (AU)

(73) Assignee: Ferno-Washington, Inc., Wilmington, OH (US)

( * ) Notice: Subject to any disclaimer, the term of this patent is extended or adjusted under 35 U.S.C. 154(b) by 50 days.

(21) Appl. No.: 10/529,105

(22) PCT Filed: Sep. 26, 2003

(86) PCT No.: PCT/US03/30429

§ 371 (c)(1),
(2), (4) Date: Nov. 14, 2005

(87) PCT Pub. No.: WO2004/028432

PCT Pub. Date: Apr. 8, 2004

(65) Prior Publication Data

US 2006/0082176 A1 Apr. 20, 2006

(30) Foreign Application Priority Data

Sep. 26, 2002 (AU) ..... 2002951782
Sep. 18, 2003 (AU) ..... 2003248014

(51) Int. Cl.
*A61G 1/02* (2006.01)

(52) U.S. Cl. ..... 5/625; 5/627

(58) Field of Classification Search ..... 5/625–627, 5/640, 620; 296/19–20
See application file for complete search history.

(56) References Cited

U.S. PATENT DOCUMENTS

| | | | | |
|---|---|---|---|---|
| 2,337,505 | A | 12/1943 | Swift | |
| 2,877,047 | A | 3/1959 | Weil | |
| 3,082,016 | A | 3/1963 | Pratt | |
| 3,088,770 | A | 5/1963 | Weil et al. | |
| 3,493,262 | A | 2/1970 | Ferneau | |
| 3,759,565 | A | 9/1973 | Ferneau | |
| 4,037,871 | A | 7/1977 | Bourgraf et al. | |
| 4,192,541 | A | 3/1980 | Ferneau | |
| 4,405,172 | A | 9/1983 | Ferneau | |
| 4,676,148 | A | 6/1987 | Foley | |
| 4,921,295 | A | 5/1990 | Stollenwerk | |
| 5,015,024 | A | 5/1991 | Bloemer | |
| 5,432,966 | A | 7/1995 | Berta et al. | |
| 5,435,027 | A | 7/1995 | Bourgraf et al. | |
| 5,509,159 | A * | 4/1996 | Du-Bois | 5/627 |
| 6,125,485 | A | 10/2000 | Way et al. | |
| 6,389,623 | B1 | 5/2002 | Flynn et al. | |
| 6,526,611 | B2 | 3/2003 | Flynn et al. | |
| 6,701,545 | B1 | 3/2004 | Ferneau et al. | |

FOREIGN PATENT DOCUMENTS

| | | |
|---|---|---|
| EP | 1 245 212 A | 10/2002 |
| FR | 2 439 583 A | 5/1980 |

OTHER PUBLICATIONS

Supplementary European Search Report dated Feb. 13, 2008 for Application No. 03770496.2.

* cited by examiner

*Primary Examiner*—Frederick Conley
(74) *Attorney, Agent, or Firm*—Dinsmore & Shohl LLP

(57) ABSTRACT

A roll-in cot (1) having a patient support attached to a wheeled transporter wherein the wheeled transporter comprises leading and trailing collapsible legs (3).

4 Claims, 17 Drawing Sheets

ROLL-IN COT

The present invention relates to emergency cots, such as of the type used to transport patients. In particular, the present invention relates to roll-in cots having collapsible legs, of the type used in emergency vehicles such as ambulances.

Emergency cots of the roll-in type are used to support a patient on a stretcher, the stretcher being mounted on a wheeled undercarriage or transporter. A patient may be manoeuvred on an emergency cot by a single operator at the trailing end or maybe manoeuvred with the assistance of other operators on the wheeled transporter.

Emergency cots of the roll-in type are configured to be able to be rolled into various types of rescue vehicles, such as ambulances, vans, station wagons, modular type rescue vehicles, aircrafts, helicopters and the like. In order to be able to roll an emergency cot into such a vehicle, the cot generally is configured to support the stretcher at a similar height to that of the platform in the emergency vehicle upon which the patient is to be transported. The undercarriage or transporter collapses to be beneath the stretcher and is supported on the platform.

During the loading of a patient onto a platform in an emergency vehicle the wheel transporter or undercarriage needs to be collapsed. As the wheeled transporter collapses, the operator is required to support the weight of the patient and the emergency cot and push the emergency cot onto the platform. In order to facilitate the loading of a patient onto such a platform, the wheeled trolley generally loading rollers at its leading end that are positioned at the height of the platform such that the loading wheels engage the platform prior to the collapse of the wheeled trolley. Thus the leading end of the emergency cot is supported on the platform and the operator supports the rear of the emergency cot.

Once the leading end of the emergency cot is supported on the platform, the operator will typically activate a handle causing part or all of the wheeled transporter to collapse. Typically, the wheeled transporter will have leading collapsible legs and trailing collapsible legs in many configurations of emergency cots. Both the leading and trailing collapsible legs are generally operated by a single handle and the operator is required to support the rear of the emergency cot for a substantial period during loading. In other configurations, separate handles have been provided for the leading collapsible legs and the trailing collapsible legs respectively. The provision of separate handles for operation of the leading and trailing collapsible legs respectively allows the leading collapsible legs to be activated initially and the emergency cot pushed further onto the platform and be supported on wheels attached to the leading legs at an intermediate position prior to the collapse of the trailing collapsible legs. In this manner, the operator is required to support a lesser weight as more of the weight of the cot and patient is supported on the platform and the moment of force is also reduced. The moment of force depends on whether the stretcher is fitted with additional sets of wheels near the centre of the stretcher such as on the collapsed, folded back loading legs. On a stretcher with only loading wheels that engage the platform the moment stays the same because the distance between the loading wheels and the operator is the same no matter how far the stretcher is moved into the vehicle. Irrespective of the weight borne by the operator, the length of time the operator has to bear the weight is reduced if the trailing wheels are collapsed at the last possible time. However, the added complexity in operating the respective handles in sequence during the loading of a patient into an emergency vehicle is often cumbersome and may result in the respective handles being operated out of sequence thereby causing the operator to have to unexpectedly support the weight of the patient and the emergency cot.

We have now found an emergency cot that enables simplified operation of the respective leading and trailing collapsible legs in the desired sequence or which overcomes or ameliorates one or more of the disadvantages described above, or which at least provides the consumer with a useful or commercial choice.

In the first broad form of the present invention there is provided a roll-in cot having a patient support attached to a wheeled transporter wherein the wheeled transporter comprises leading and trailing collapsible legs having respective proximal ends pivotally connected to a frame and distal ends including wheels wherein at least the leading or the trailing collapsible legs are operable from a locked condition by a release assembly wherein the release assembly comprises a safety and a leg release wherein one of said safety and said leg release comprises a linkage, wherein in an activated condition the linkage prevents the collapse of the collapsible legs, said linkage is connected to a touch bar disposed in front of said collapsible legs whereby engagement of the touch bar against a platform deactivates the linkage and enables the collapsible legs to be collapsed on release of the other of said safety and said leg release.

The patient support used in the roll-in cot of the present invention may be in any convenient form. Suitably, the patient support may be in the form of a stretcher. However, it will be appreciated that other patient support configurations may be used such as chairs or the like. It is preferred that the patient support be in the form of a segmented stretcher whereby respective segments may be contoured to provide improved support for the patient.

The patient support may be removably attached to the wheeled transporter. The patient support may be a detachable stretcher that may be reversibly attached to the frame of the wheeled transporter. However, it is within the scope of the present invention for the patient support to be permanently affixed to the wheeled transporter.

The wheeled transporter includes a frame on which the patient support is mounted and to which the leading and trailing collapsible legs are pivotally connected. The frame may be of any convenient configuration and may preferably be adjustable in height such that the roll-in cot may be readily loaded into an emergency vehicle. The frame may also include provision for the attachment of medical appliances thereto that may be associated with patient transport. For example, the frame may include a receptacle for holding an oxygen cylinder or heart monitoring equipment.

The leading and trailing collapsible legs are typically each in the form of a pair of legs, one by on either side of the frame so as to provide stability to the loaded cot. Preferably, a pair of leading legs will be spaced apart by a greater or lesser distance than a trailing pair of legs such that in a collapsed state the respective pairs of legs can collapse into a nested configuration.

An alternative configuration employs a single leading leg and/or a single trailing leg, each spaced apart wheels at the distal ends thereof. In order to further explain the present invention the cot will be described with reference to a cot having pairs of leading and trailing collapsible legs and it will be appreciated that the invention embrace cots with other leg configurations.

Whilst it is within the scope of the present application that the collapsible legs fold in a forward direction, it is preferred that the legs fold rearwardly whereby they are urged in a rearward direction by the relative movement of the cot relative to the platform.

The leading and trailing collapsible legs are pivotally connected to the frame. It is preferred that the respective pairs of collapsible legs be connected to the frame through a hinge that extends the width of the frame and through the proximal end of the respective pairs of collapsible legs. It is preferred that the respective pairs of collapsible legs be provided with bracing members that extend there between to stabilise the respective pairs of collapsible legs. The respective pairs of collapsible legs may be splayed, i.e. that the leading pair of collapsible legs be angled forward and the trailing pair of collapsible legs be angled backwards. A strut may extend from the respective pairs of collapsible legs, which strut may engage the frame thereby retaining the collapsible legs in a locked condition. Vertical legs may also be used. At the distal end of the collapsible legs wheels are provided so as to enable the roll-in cot to be readily manoeuvred by a single operator. The wheels may be rotatably mounted on the distal ends of the collapsible legs so as to form casters or the like. Rotatably mounted wheels may be selectively locked, preferably in line with the roll-in cot so that the roll-in cot may be pushed in a straight line.

In the locked condition, the pairs of legs are retained in an erect condition and by either deactivating the leg release or the safety will not cause the legs to collapse.

In one embodiment, the leg release and the safety both independently retain a pair of legs in and erect condition and thus the deactivation of either is insufficient to collapse the legs. In another embodiment, the safety may limit the leg release and prevent it from being deactivated and retain the pair of legs in an erect condition.

Both the leading and trailing pairs of collapsible legs include a release assembly for initiating the collapse of the respective pairs of legs. The mechanisms may be independent, or integrated to a greater or lesser extent.

The linkage may be in the form of a pawl and stop, in the form of a pin-in-slot, incorporate a detent, lug, tab, hook or other similar means that directly or indirectly retains the legs in an erect state whilst the linkage is in an activated condition.

The release assembly comprises a leg release and also includes a safety whereby operation of both the safety and the leg release are required to collapse the legs of the cot. In the content of the present invention where a touch bar is used, the presence of a leg release and a safety prevents the inadvertent collapse of wheels due to an accidental knock to the touch bar.

The release assembly comprising a leg release and a safety may on one embodiment comprise a leg release and a safety that independently retain the legs in an erect condition. In this embodiment, either the leg release or the safety includes a linkage connected to a touch bar.

In another embodiment the leg release may retain the legs of the cot in an erect condition and operation of the leg release may be limited by the safety such that when the safety is in an activated condition it is not possible for the leg release to completely deactivated whereby the legs collapse. In this embodiment either the leg release or the safety includes a linkage connected to the touch bar.

The roll-in cot of the first broad form of the present invention allows the operator to place the collapsible legs in a deactivated condition without the legs collapsing and then to collapse the legs at the last possible moment before the cot is loaded on a platform. The roll-in cot of this embodiment minimises the likelihood of unintentional collapse of the legs of the cot by employing a touch bar associated with the collapsible legs. As the touch bar engages a platform the legs either are moved from a locked condition to a collapsible condition or are moved from a collapsible condition to a collapsed condition. In this manner unintentional or early operation of a handle or other release mechanism will not collapsed the cot or result in the operator having to bear the weight of the patient and the emergency cot for an extended period as it is loaded on to a platform.

In certain embodiments of the present invention, collapsible legs are operable by a release assembly comprising a safety and a leg release as broadly described above. In a preferred embodiment, both the leading and trailing collapsible legs are operable by such a release assembly.

The preferred release assembly for use in the present invention includes a leg release and a safety. By employing a touch bar to operate either the leg release or the safety, the legs can only be collapsed with both the leg release and the safety in a deactivated condition. With either the leg release or the safety in an activated condition the legs remain in an erect condition supporting the patient. In this way the likelihood of an unintentional collapse of the roll-in cot is minimised.

The leg release and the safety typically include a linkage such as a latching assembly that retains the legs in an erect condition. Suitably a latching assembly may include a pin or other detent mechanism. In one form, the latching assembly may include a pin-in-slot to prevent movement or collapse of the legs. In another form, the latching assembly may include a hook that engages either an eye or a shaft.

The latching assembly may be operated by a touch bar or a suitable handle that is connected to the detent mechanism. A suitable handle may be directly connected to the detent mechanism in the form of a lever or may be connected by a cable or other suitable mechanism.

The safety may be a secondary latching assembly that also holds the legs in an erect condition. In this embodiment, the safety may be in similar form to that of the leg release save for one of either the safety or the leg release being operated by the touch bar.

In another embodiment, the safety may prevent the operation of the leg release. The safety may limit or govern the movement of the leg release, such as at the latching assembly that forms part of the leg release. For example, where the leg release comprises a pin-in-slot assembly the safety may prevent the pin being totally withdrawn from the slot and thereby prevent the collapse of the legs.

Either the leg release or the safety incorporates a linkage connected to a touch bar whereby pushing the touch bar against a platform deactivates in the linkage.

In a second broad form the present invention provides a roll-in cot having a patient support attached to a wheeled transporter wherein the wheeled transporter comprises leading and trailing collapsible legs having respective proximal ends pivotally connected to a frame and distal ends including wheels wherein the trailing collapsible legs are operable from a locked condition by a release assembly comprising a safety and a leg release wherein said leg release comprises a handle connected to a pawl, wherein in an activated condition the pawl abuts a stop, said stop is disposed on the safety and is connected to a touch bar disposed in front of the trailing collapsible legs whereby engagement of the touch bar against platform withdraws the stop from abutment with the pawl and releases the trailing collapsible legs.

The roll-in cot of the third broad form of the present invention allows the operator to activate the handle for collapsing the trailing pair of collapsible legs without the legs collapsing until a touch bar associated with the trailing pair of collapsible legs engages a platform. In this manner, unintentional or early operation of the handle will not result in the operator having to bear the weight of the patient and the emergency cot until the emergency cot is positioned where the touch bar engages the platform.

The trailing pair of collapsible legs is operable from a locked condition by a leg release. In a preferred configuration the leg release may releasably engage a rearwardly extending strut to as to allow the trailing pair of collapsible legs to be pivoted towards the frame.

The leg release comprises a handle connected to a pawl. Preferably, the handle is located at the trailing end of the frame such that an operator manoeuvring the roll-in cot may readily access the handle from a position rearward of the roll-in cot.

It will be appreciated that the handle may be disposed on any convenient location on the cot or activated remotely. The pawl may be disposed at any convenient location on the frame. Preferably, the pawl may be directly connected to the handle. Activation of the handle moves the pawl into abutment with a stop disposed on the safety. In the inactivated condition, the pawl is retained in and against a fixed detent on the safety whereby any accidental movement of the touch bar will not permit the trailing collapsible legs to collapse.

In an activated condition the pawl on the leg release abuts the stop on the safety. The stop is connected to a touch bar disposed in front of the trailing pair of collapsible legs. Movement of the roll-in cot towards the platform, such as may be disposed on an emergency vehicle, causes the touch bar to engage the platform and withdraw the stop from abutment with the pawl and permit the trailing collapsible legs to collapse. The touch bar may preferably engage a rear bumper bar of an ambulance or any other convenient part of the platform.

In a preferred embodiment of the present invention, the pawl is in the form of a cam follower and the stop is part of a camming surface against which the cam follower moves. In the activated condition, the cam follower is prevented from moving to a position where the trailing pair of collapsible legs may be released by the orientation of the camming surface. The touch bar is connected to the camming surface and on engagement with the platform, causes the camming surface to be rotated thereby permitting the cam follower to move to a position where the collapsible legs are released.

In a preferred configuration of the second broad aspect of the present invention, the leading collapsible legs may be released by the operation of the handle whereby the pawl is moved to an activated condition. In this way a single handle may be used to selectively operate the leading collapsible legs and the trailing collapsible legs. In a preferred form, the handle extends from a bar mounted on the frame by a pair of opposed arms. The pair of opposed arms are pivotably mounted on the frame and the bar respectively such that longitudinal movement of the bar relative to the frame by operation of the handle causes the bar to move laterally with respect to the frame. As the handle is moved to an activated condition, a pawl fixedly mounted on the bar engages a camming surface and is restricted in lateral movement. In the activated condition, the bar is moved to an intermediate lateral position. A pin or other release mechanism for the leading pair of collapsible legs is operated by the movement of the bar to the intermediate lateral position and the leading collapsible legs released. In the intermediate lateral position the release mechanism, such as a pin, for the trailing collapsible legs is retained in a locked condition. Upon engagement of the touch bar with the platform the camming surface is rotated, thereby allowing the cam follower or pawl to move further laterally relative to the frame and release the trailing collapsible legs.

It is preferred that load wheels be mounted on the frame and the collapsible legs to facilitate the loading of the roll-in cot onto the platform, such as in the rear of an ambulance. Load wheels are preferably provided at the leading end of the frame at a height that allows ready engagement on the platform. Additional load wheels are also preferably provided on the leading side of the leading collapsible legs as well as the leading side of the trailing collapsible legs. Load wheels may also be mounted on the underside of the main frame at one or more predetermined positions. It is preferred that in the collapsed position all of the load wheels are substantially aligned so as to sit flatly on the platform. The roll-in cot may include a locking assembly to retain it in position on the platform.

In a third broad form, the present invention provides a roll-in cot having a patient support attached to a wheeled transporter wherein the wheeled transporter comprises leading and trailing collapsible legs having respective proximal ends pivotally connected to a frame and distal ends including wheels wherein the leading collapsible legs are operable from a locked condition by a release assembly comprising a leg release and a safety, the leg release comprises a handle connected to a pawl, wherein in an activated condition the pawl retains the leading collapsible legs in an erect condition and the safety is connected to a touch bar disposed adjacent load wheels whereby engagement of the touch bar against platform deactivates the safety wherein the release assembly requires both the leg release and the safety to be deactivated for the leading pair of collapsible legs to be collapsed.

The roll-in cot of the third broad form of the present invention allows the operator to activate the handle for collapsing the leading collapsible legs without the legs collapsing until a touch bar engages a platform. In this manner unintentional or early operation of the handle will not result in the collapse of the leading end of the cot.

The leading pair of collapsible legs is operable from a locked condition by a release assembly. In a preferred configuration the leg release may releasably engage a forwardly extending strut to as to allow the leading pair of collapsible legs to be pivoted towards the frame upon deactivation of the safety.

The leg release comprises a handle connected to a pawl. Preferably, the handle is located at the trailing end of the frame such that an operator manoeuvring the roll-in cot may readily access the handle from a position rearward of the roll-in cot. The pawl may be disposed at any convenient location on the frame. Preferably the pawl may be directly connected to the handle and engage the leading collapsible legs.

In a further embodiment of the present invention either the leg release or the safety may be operable by a proximity switch that senses whether the cot is positioned adjacent a platform such as a emergency vehicle. In combination with a touch bar operating the other of the leg release or the safety the cot my be safely loaded onto the platform without the operation being required to operate manual release.

In a fourth broad form the present invention includes a method of loading a roll-in cot onto a platform said method comprising the steps of:

moving the roll-in cot against a platform;

operating a touch bar by urging the roll-in cot into the platform wherein movement of the touch bar relative to the frame disengages a linkage and permits collapsible legs on the cot to collapse; and moving the roll-in cot onto the platform.

The undercarriage of the roll-in cot of the present invention may find use in other applications as will be apparent to the skilled addressee.

In order that the invention may be more fully understood and put into practice, preferred embodiments thereof will now be descried with reference to the accompanying drawings.

Figure 1:
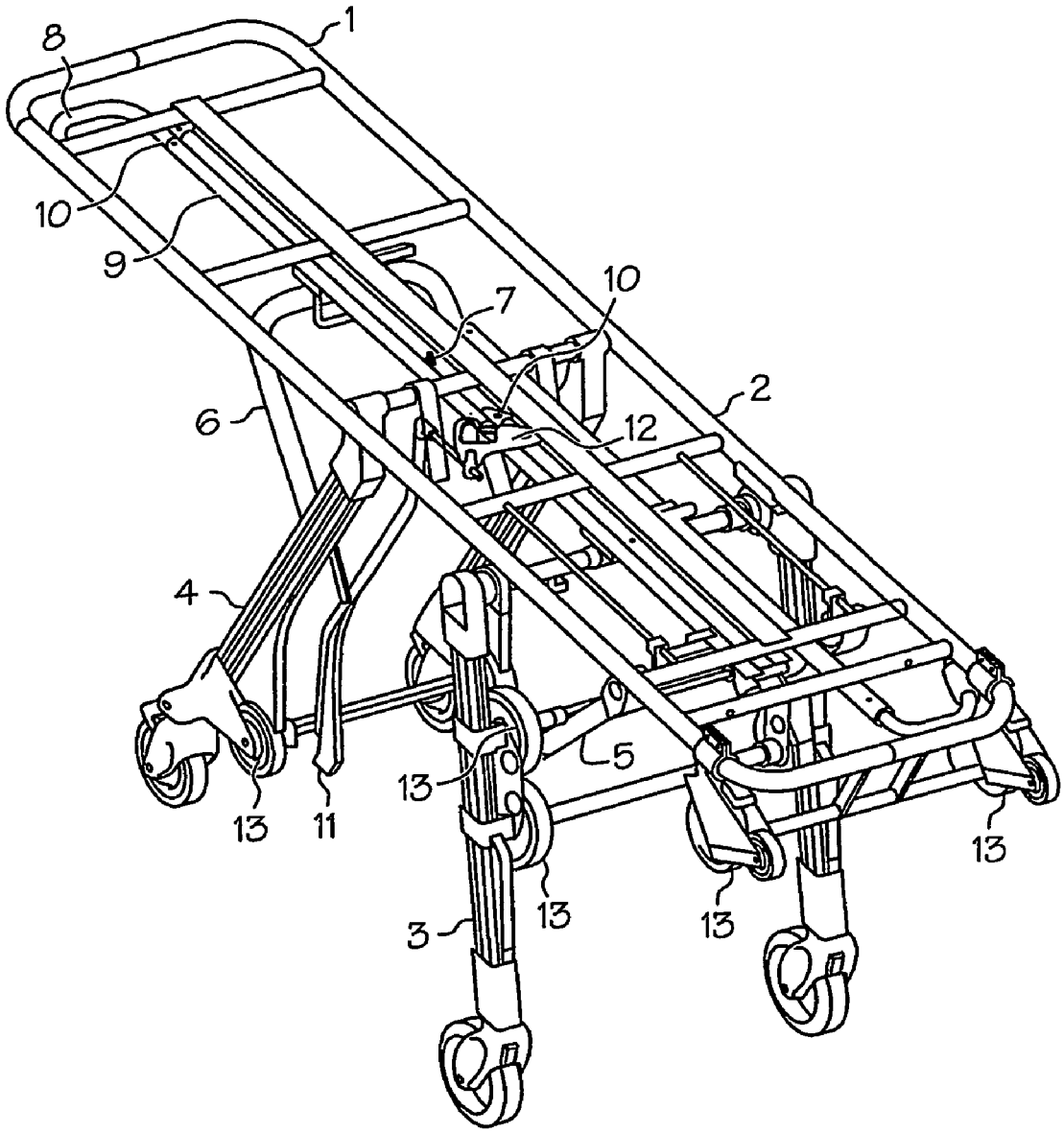
FIG. 1 is a perspective view of a wheeled transporter according to one embodiment of the present invention.

FIG. 1 shows a roll-in cot 1 with the stretcher or patient support removed for the sake of clarity. The roll-in cot is formed from a frame 2 on which are pivotally mounted a leading pair of collapsible legs 3 and a trailing pair of collapsible legs 4. In the elevated condition shown, the roll-in cot 1 is supported on the leading pair of collapsible legs 3 and trailing pair of collapsible legs 4. The leading pair of collapsible legs 3 is locked into position by a support strut 5 that is locked to the frame 2. The trailing pair of collapsible legs is locked in position by a support strut 6 locked to the frame 2. A release assembly 7 is operated by a handle 8 that actuates a bar 9 by moving the bar 9 rearwardly relative to the roll-in cot 1.

On operation of the handle 8 so as to move the bar 9 in a rearward direction bar 9 is displaced laterally by arms 10 that are pivotally mounted to both the frame and to bar 9. Operation of the release assembly 7 will be described in further detail with reference to FIGS. 2A to 7B.

The release assembly 7 also includes a touch bar 11 for engagement with the rear of a platform. Actuation of touch bar 11 causes a cam 12 to be rotated on the frame 2. Rotation of the cam 12 on frame 2 allows the bar 9 to move further in a lateral direction.

In the collapsed position the frame has loading wheels 13 located on the frame 2 as well as on the leading space of the leading pair of collapsible legs 3 and the trailing pair of collapsible legs 4.

Figure 2A:
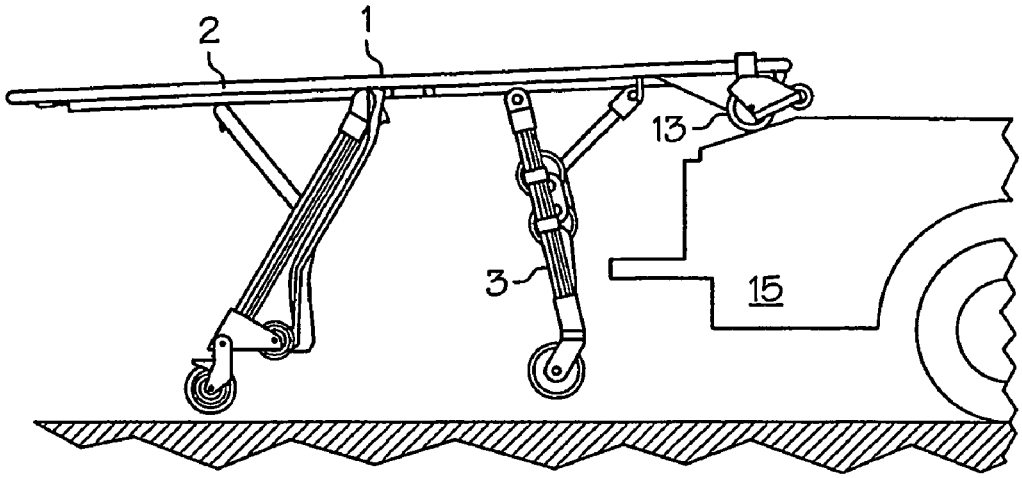
FIG. 2A is a side view of the roll-in cot of FIG. 1 in a first position.
Figure 2B:
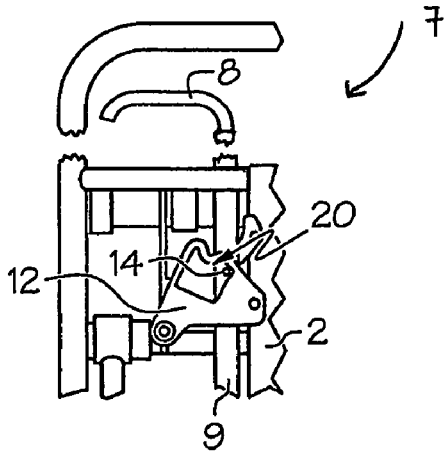
FIG. 2B is a top section view of the roll-in cot of FIG. 2A, showing a corresponding position of a release assembly according to the present invention.

FIG. 2A shows the roll-in cot 1 engaging the rear of an emergency vehicle 15 such as an ambulance. The loading wheels 13 that are disposed on the front of the frame 2 engage in emergency vehicle 15. In the first position the handle 8 is shown in FIG. 2B in a neutral position as is the bar 9 and the cam 12. A pawl 14 is mounted on the bar 9 so as to cooperate with the camming surface 20 of the cam 12.

Figure 3A:
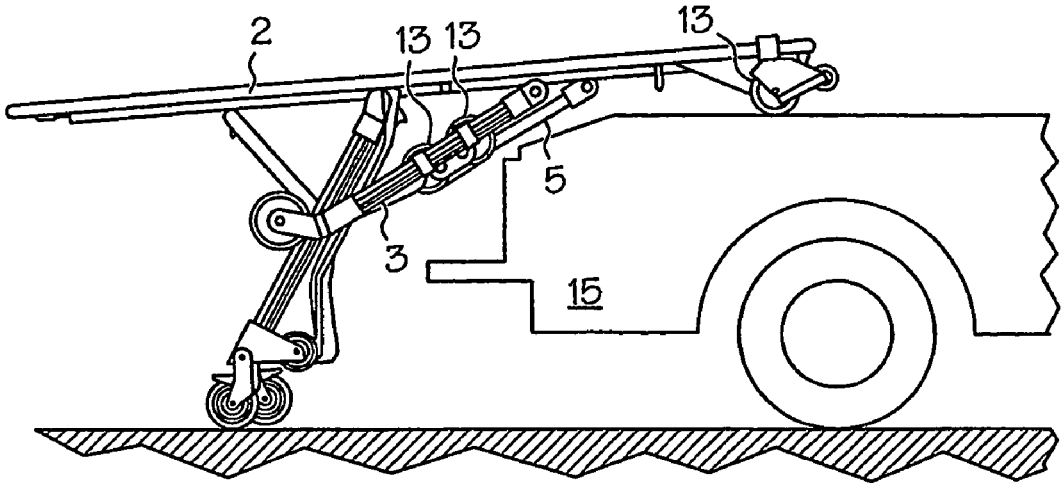
FIG. 3A is a side view of the roll-in cot of FIG. 1 in a second position.
Figure 3B:
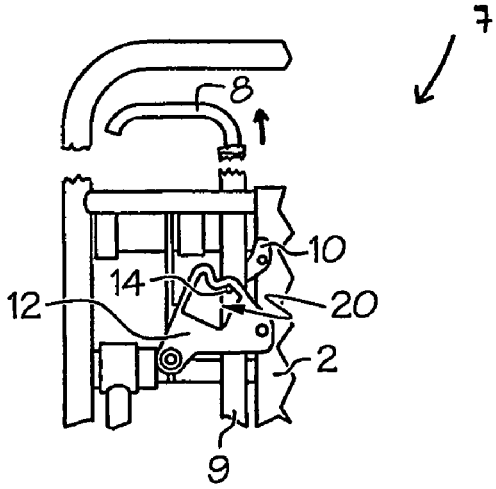
FIG. 3B is a top section view of the roll-in cot of FIG. 3A, showing a corresponding position of a release assembly according to the present invention.

In a second position shown in FIG. 3A the loading wheels 13 positioned at the front of frame 2 are further advanced onto the emergency vehicle 15. The handle 8 is moved to an activated position and the bar 9 is moved laterally relative to frame 2 by the rotation of arm 10 relative to the frame 2 and the bar 9 as shown in FIG. 3B. In the activated condition pawl 14 is moved rearwardly with respect to the frame 2 and engages a stop on the camming surface 20 in this activated condition support strut 5 is slideably released from fixed engagement with the frame 2, thereby allowing the leading pair of collapsible legs 3 to rotate relative to the frame 2. The loading wheels 13 that are disposed on the leading pair of collapsible legs 3 are then able to engage the emergency vehicle 15 so as to assist in a supporting the roll-in cot 1.

Figure 4A:
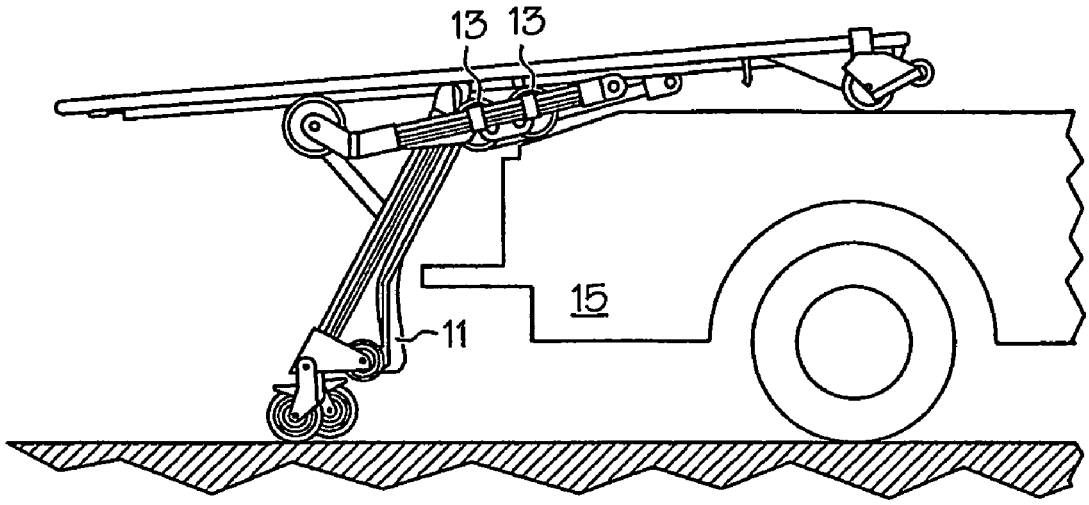
FIG. 4A is a side view of the roll-in cot of FIG. 1 in a third position.
Figure 4B:
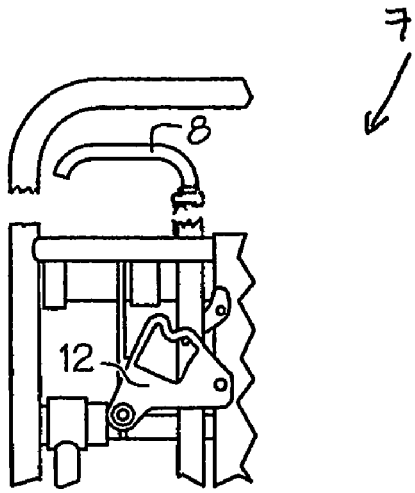
FIG. 4B is a top section view of the roll-in cot of FIG. 4A, showing a corresponding position of a release assembly according to the present invention.

FIG. 4A shows the roll-in cot 1 in a third position with the loading wheels 13 further advanced on the emergency vehicle 15. The position of the handle 8 and the cam 12 in FIG. 4B are the same as that shown in FIG. 3B.

Figure 5A:
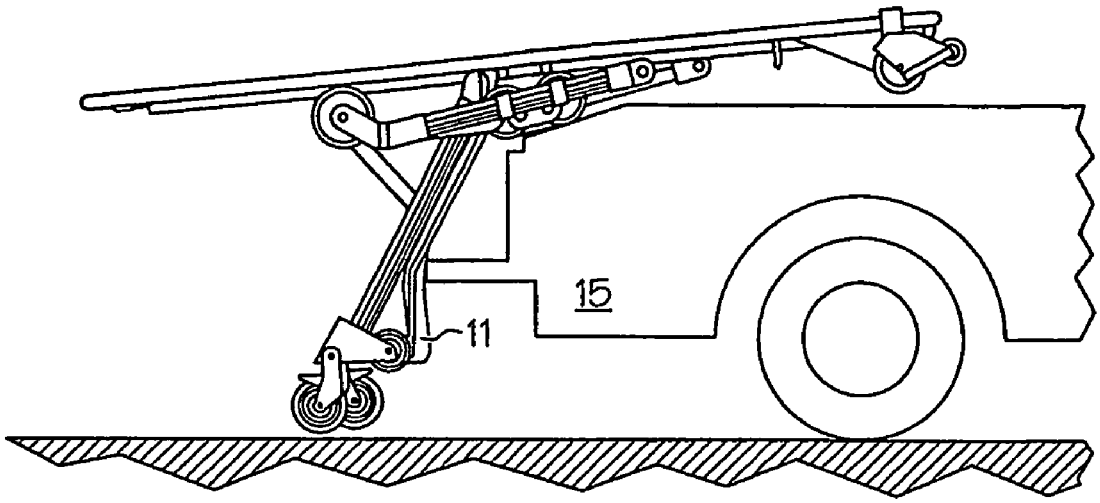
FIG. 5A is a side view of the roll-in cot of FIG. 1 in a fourth position.
Figure 5B:
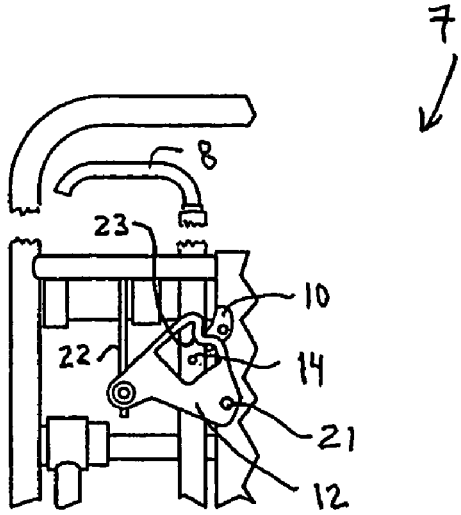
FIG. 5B is a top section view of the roll-in cot of FIG. 5A, showing a corresponding position of a release assembly according to the present invention.

In FIG. 5A the touch bar 11 has engaged the emergency vehicle 15. Operation of the touch bar 11 activates a push rod 22 shown in FIG. 5B and causes the cam 12 to rotate relative to frame 2 about pivot 21. Rotation of cam 12 releases the pawl 14 from the stop on the camming surface 20 thereby slideably releasing the support strut 6 from locking engagement with the frame 2.

Figure 6A:
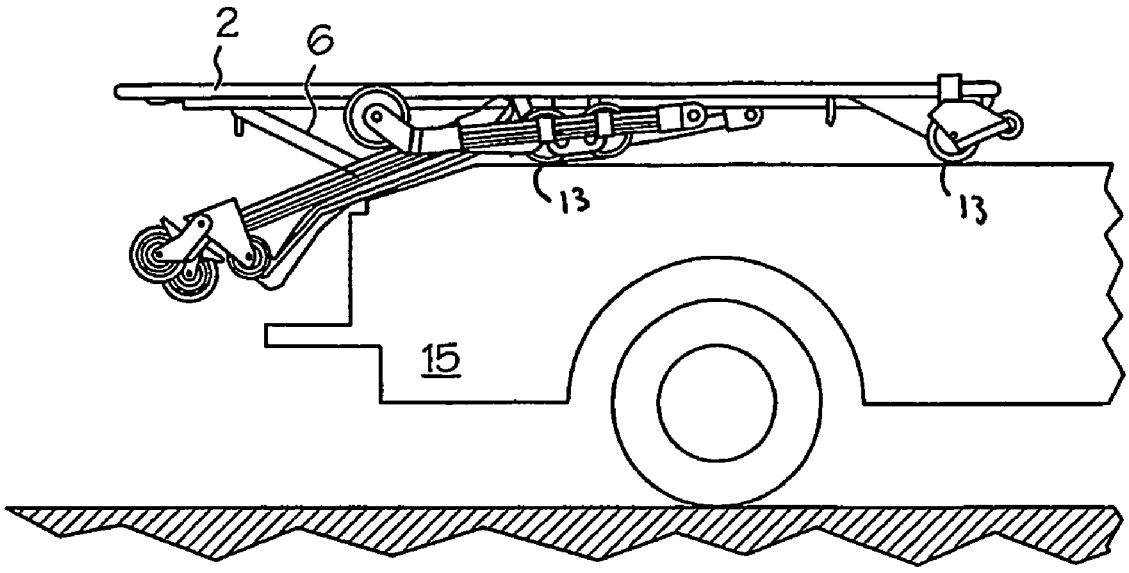
FIG. 6A is a side view of the roll-in cot of FIG. 1 in a fifth position.
Figure 6B:
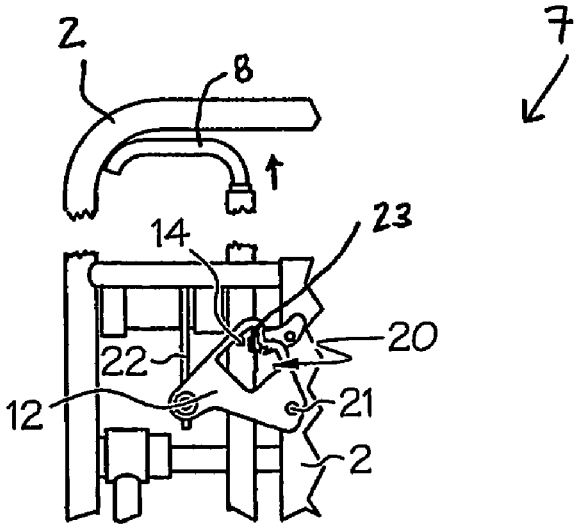
FIG. 6B is a top section view of the roll-in cot of FIG. 6A, showing a corresponding position of a release assembly according to the present invention.

FIG. 6A shows the roll-in cot 1 in a fifth position with the loading wheels 13 supporting the weight of the cot on the emergency vehicle 15, and with the support strut 6 folding under the frame 2 along with the trailing pair of collapsible legs 4. As shown in FIG. 6B, as the handle 8 is positioned to it full release position adjacent the frame 2, the cam 12 rotates relative to frame 2 about pivot 21 such that the pawl 14 advances clearing the stop 23 on the camming surface 20.

Figure 7A:
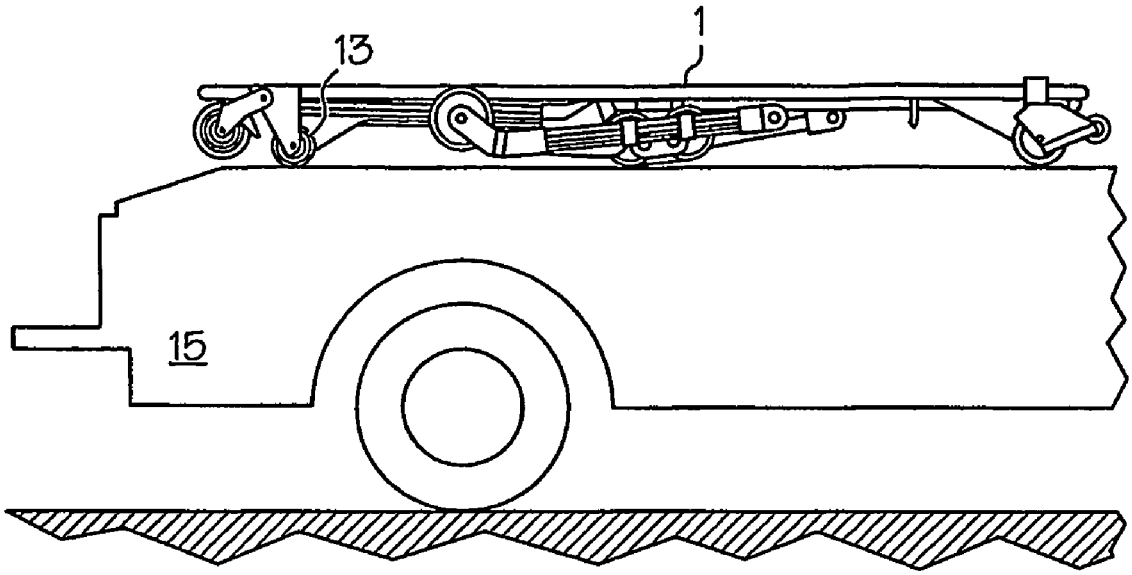
FIG. 7A is a side view of the roll-in cot of FIG. 1 in a sixth position.
Figure 7B:
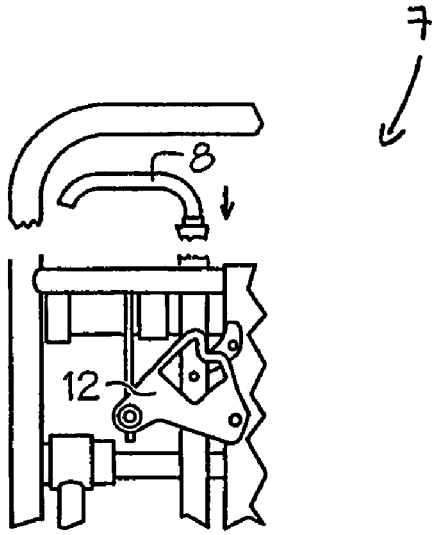
FIG. 7B is a top section view of the roll-in cot of FIG. 7A, showing a corresponding position of a release assembly according to the present invention.

FIG. 7A shows the roll-in cot 1 fully advanced onto the emergency vehicle 15 with the loading wheels 13 positioned on the trailing pair of collapsible legs advanced onto the emergency vehicle 15. As shown in FIG. 7B, releasing the handle 8 sends the pawl 14 forward of the stop 23 such that when the trailing pair of collapsible legs 4 are once again extended, the release assembly 7 resets to the locking position shown in FIG. 2B.

Figure 8A:
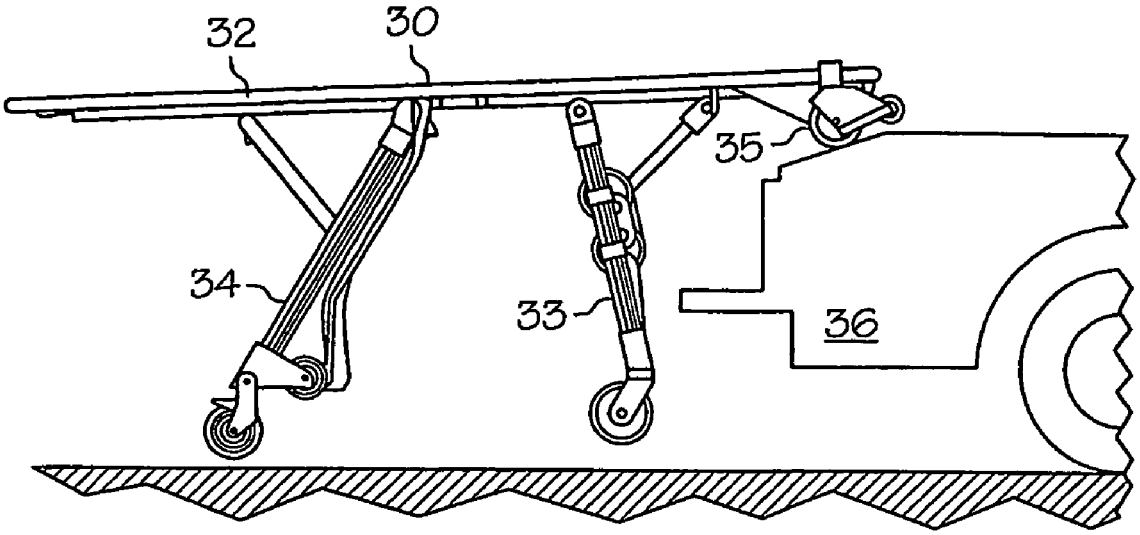
FIG. 8A is a side view of a roll-in cot according to the present invention in a first position.
Figure 8B:
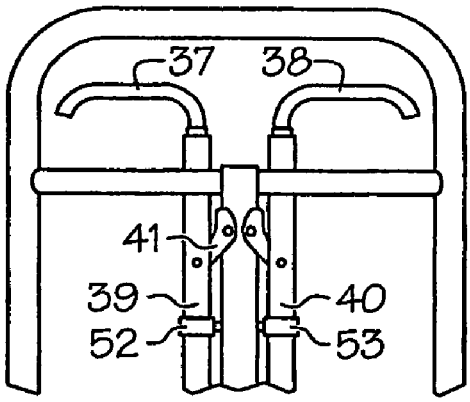
FIG. 8B is a top section view of the roll-in cot of FIG. 8A, showing a corresponding position of a release assembly according to the present invention.

FIG. 8A shows a roll-in cot 30 having a leading pair of collapsible legs 33 and a trailing pair of collapsible legs 34, with a leading loading wheel 35 engaged to an emergency vehicle 36. The respective pairs of collapsible legs 33, 34 are rotatably mounted on frame 32. FIG. 8B shows a handle 37 used to release of the leading pair of collapsible legs 33 and a primary lock 52 on the trailing pair of collapsible legs 34. A handle 38 is also provided to manually release the secondary lock 53, and is shown in the neutral position, as are bars 39 and 40 respectively.

Figure 9A:
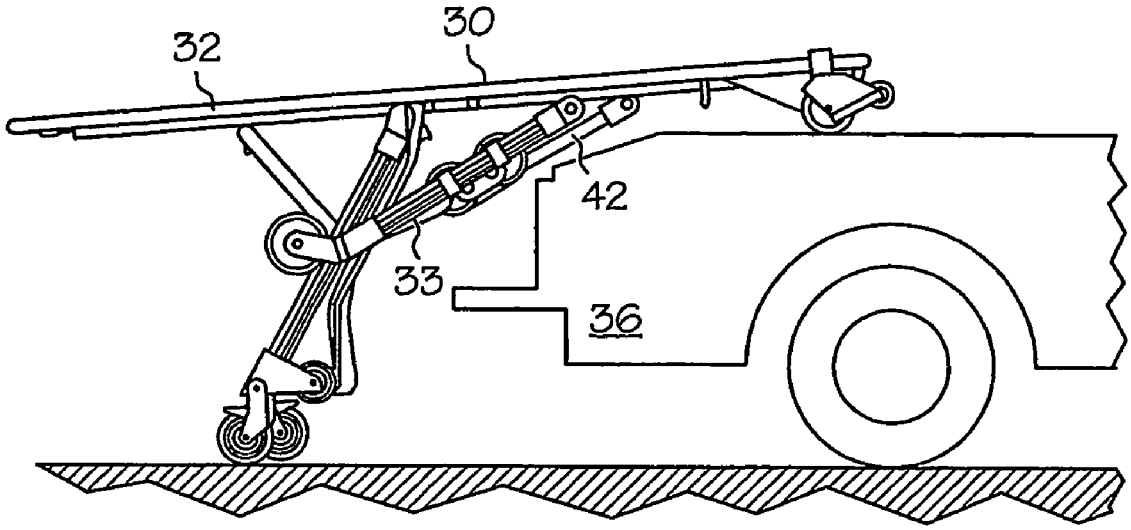
FIG. 9A is a side view of the roll-in cot of FIG. 8A in a second position.
Figure 9B:
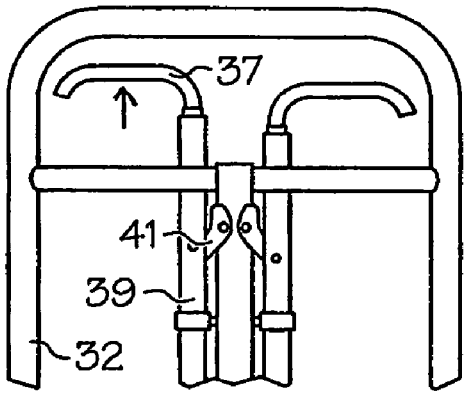
FIG. 9B is a top section view of the roll-in cot of FIG. 9A, showing a corresponding position of a release assembly according to the present invention.
Figure 10A:
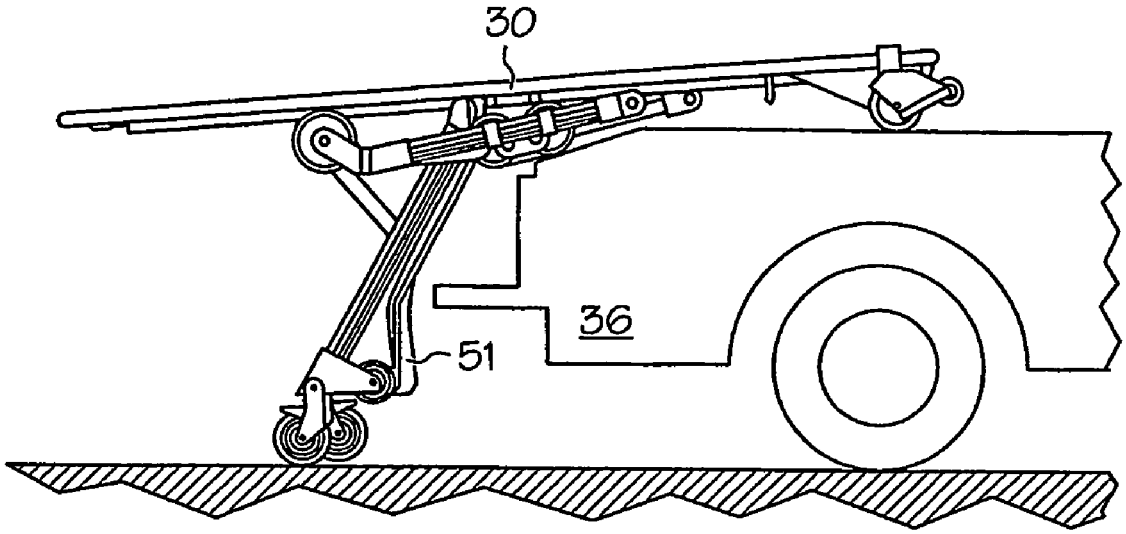
FIG. 10A is a side view of the roll-in cot of FIG. 8A in a third position.
Figure 10B:
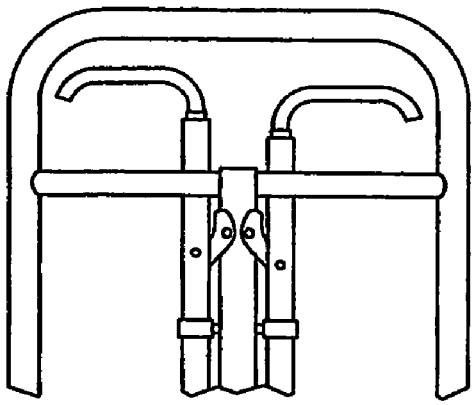
FIG. 10B is a top section view of the roll-in cot of FIG. 10A, showing a corresponding position of a release assembly according to the present invention.

FIG. 9A shows the roll-in cot 30 in a second position with the leading pair of collapsible legs 33 partially collapsed. As shown in FIG. 9B, the handle 37 has been moved to an activated condition whereby the bar 39 has advanced rearwardly relative to frame 32. By arm 41 pivotably mounted to frame 32 and to bar 39 the bar 39 is urged laterally causing support strut 42 to be slideably released from fixed engagement with the frame 32, thereby allowing the leading pair of collapsible legs 33 to rotate relative to the frame 32. The lateral movement of bar 39 also causes the primary lock 52 on the trailing pair of collapsible legs 34 to be released. At this stage, the trailing pair of collapsible legs 34 are still secured to frame 32 by secondary lock 53. FIGS. 10A and 10B show the roll-in cot 30 further advanced onto the emergency vehicle 36.

Figure 11A:
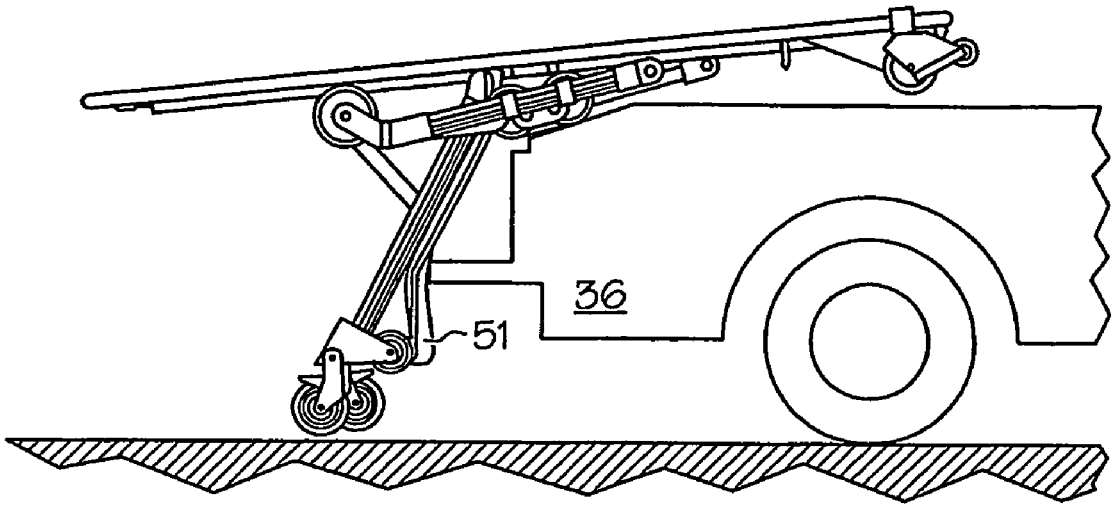
FIG. 11A is a side view of the roll-in cot of FIG. 8A in a fourth position.
Figure 11B:
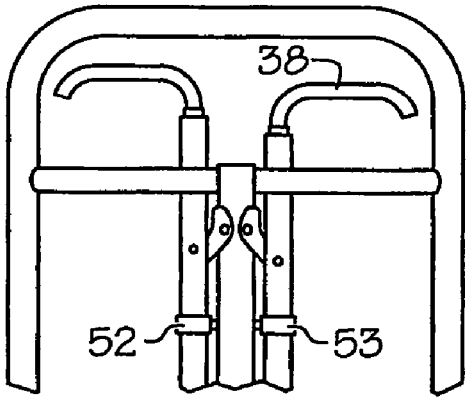
FIG. 11B is a top section view of the roll-in cot of FIG. 11A, showing a corresponding position of a release assembly according to the present invention.

FIG. 11A shows touch bar 51 in engagement with the emergency vehicle 36. Activation of touch bar 51 causes the secondary lock 53 on the trailing pair of collapsible legs 34 to be released. As shown in FIG. 11B, operation of handle 38 is not required during loading of the roll-in cot. It is used in situations were the height of the cot with stretcher attached is used to assist in loading a patient onto the stretcher.

Figure 12A:
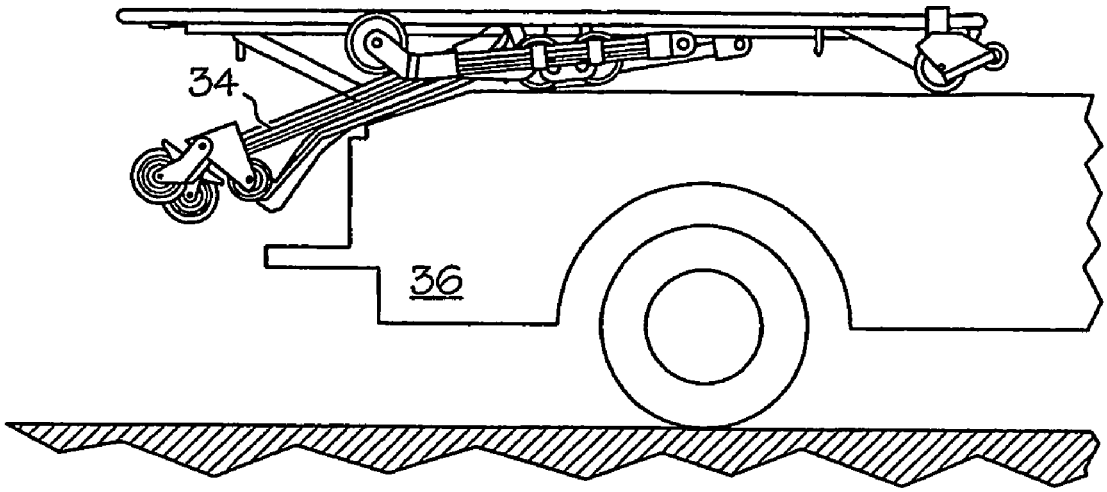
FIG. 12A is a side view of the roll-in cot of FIG. 8A in a fifth position.
Figure 12B:
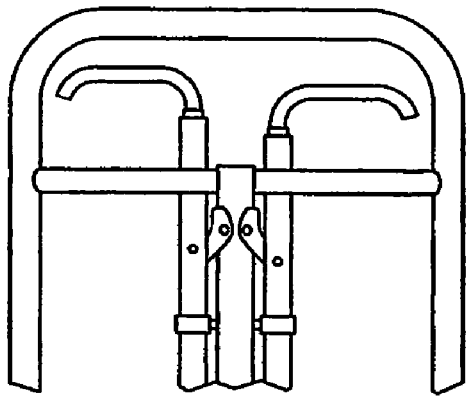
FIG. 12B is a top section view of the roll-in cot of FIG. 12A, showing a corresponding position of a release assembly according to the present invention.
Figure 13A:
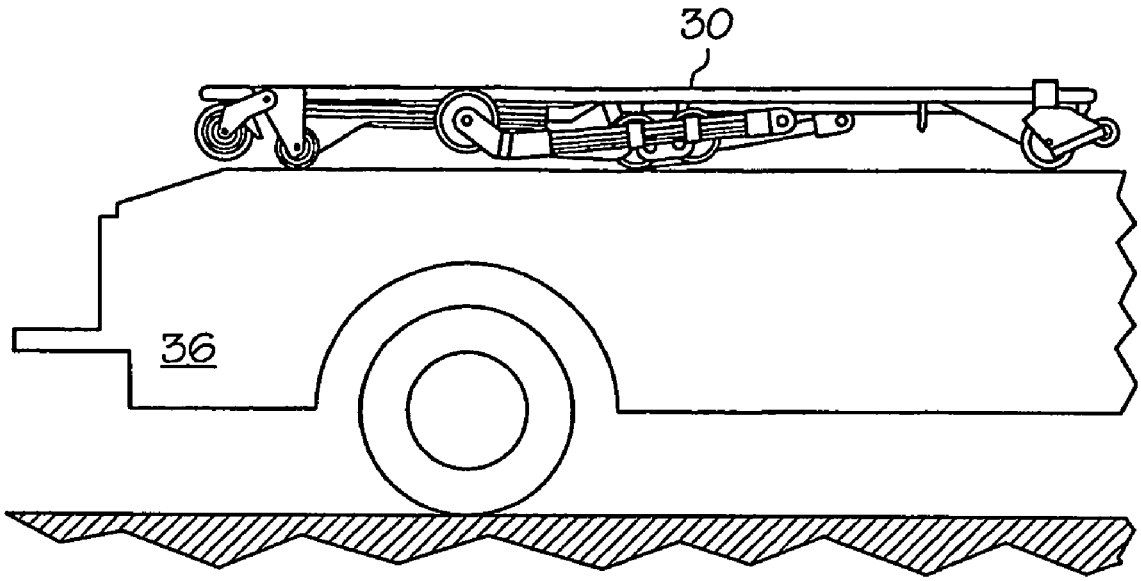
FIG. 13A is a side view of the roll-in cot of FIG. 8A in a sixth position.
Figure 13B:
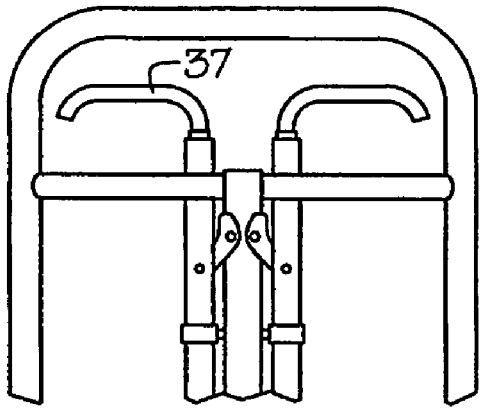
FIG. 13B is a top section view of the roll-in cot of FIG. 13A, showing a corresponding position of a release assembly according to the present invention.

FIGS. 12A and 12B show the trailing pair of collapsible legs released, and FIGS. 13A and 13B show the roll-in cot 30 fully loaded onto the emergency vehicle 36.

Figure 14:
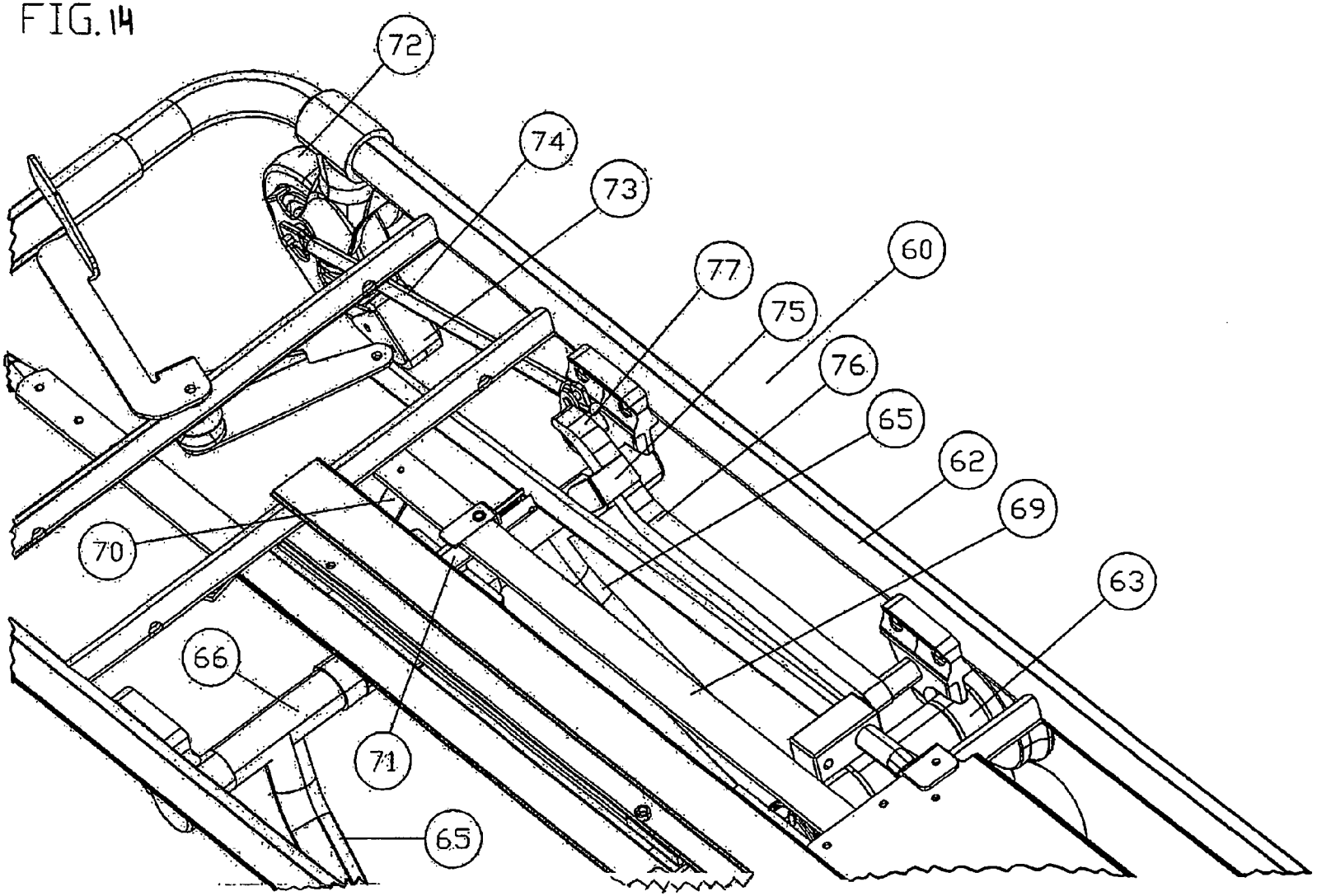
FIG. 14 is an elevated perspective view of a leading part of a roll-in cot according another embodiment of the present invention.

FIG. 14 shows a leading portion of a roll-in cot 60 with the stretcher or patient support removed for the sake of clarity. The roll-in cot 60 is formed from a frame 62 on which are pivotally mounted a leading pair of collapsible legs 3 and a trailing pair of collapsible legs 4. In the elevated condition shown, the roll-in cot 1 is supported on the leading pair of collapsible legs (not shown) on a pivoting mount 63. The leading pair of collapsible legs (not shown) is locked into position by a support struts 65 that are locked to the frame 62 by cross member 66.

A release assembly is operated by a handle not shown that actuates a bar 69 by moving the bar 69 rearwardly relative to the roll-in cot 60. The release assembly includes a mechanism for releasing the trailing legs with in a manner similar to that shown in FIGS. 1 to 7B. Operation of the release assembly has been described in further detail with reference to FIGS. 2A to 7B.

Rearward movement of bar 69 also results in lateral movement as bar 69 is connected to lever 70 that is pivotally mounted to both bar 69 and frame 62. A pin 71 engages the cross member 66 when the handle is in a locked condition. Operation of the handle causes rearward movement of bar 69 and consequent lateral movement that withdraws pin 71 from the frame 69 and allows cross member 66 to slide against bar 69 thereby putting the leading collapsible legs (not shown) in a collapsible condition. Load wheel 72 has a touch bar 73 pivotally mounted in close proximity thereto. Touch bar 73 is connected to bar 74 across a fulcrum whereby rearward movement of the touch bar 73 results in forward movement of bar 74. The bar 74 is connected to a pivoting hook 75 across a fulcrum whereby forward movement of bar 74 lifts pivoting hook 75 away from cross member 66. In the inactivated condition in the pivoting hook 75 is urged to engage cross member 66 and preventing it moving rearwardly.

Arm 76 is pivotally connected to the frame 62 and rides up on cross member 66 as cross member 66 moves rearwardly. The leading end 77 of arm 76 engages the pivoting hook 75 and retains the bar 74 in a forward condition whereby the touch bar 73 is retained in a raised condition away from the platform so as to allow free movement of the cot 60.

Figure 15A:
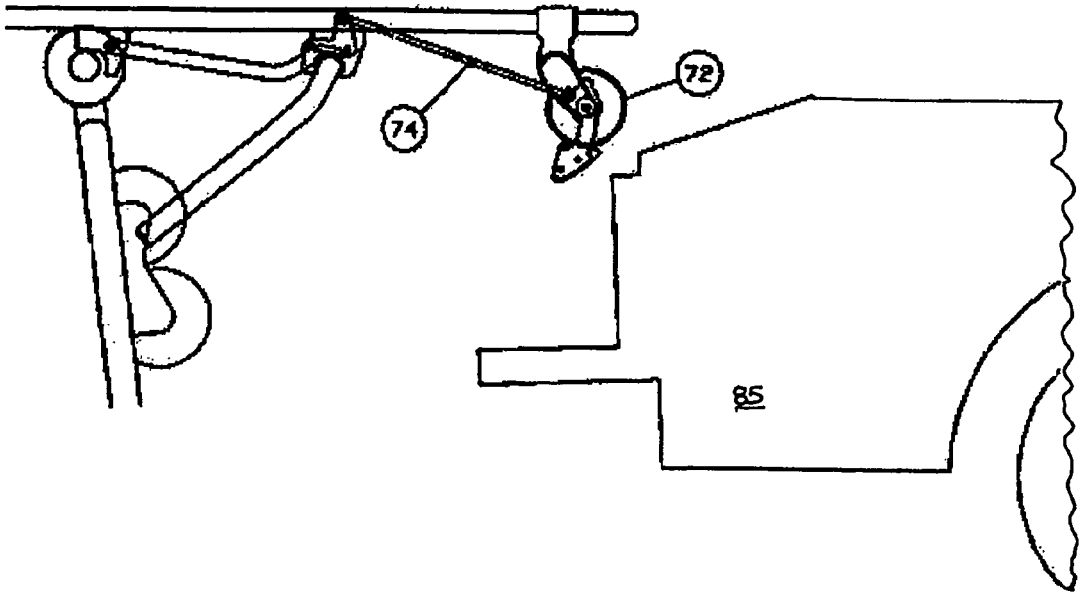
FIG. 15A is a side view of the roll-in cot of FIG. 14 in a first position.
Figure 15B:
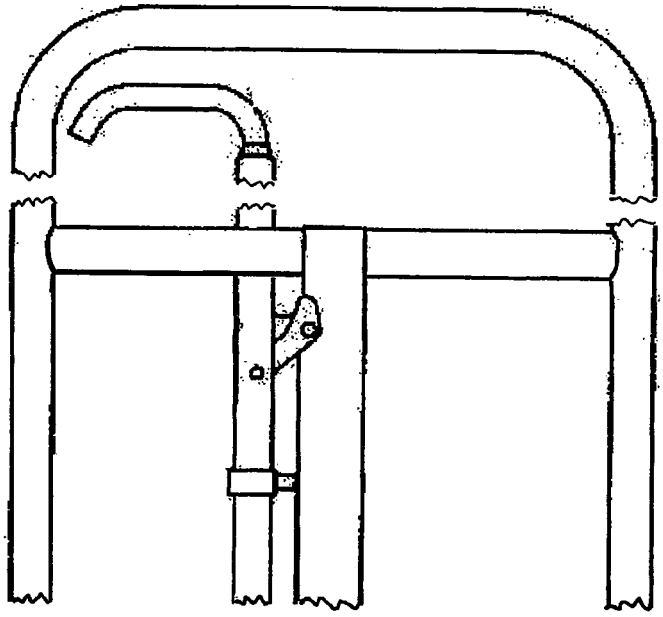
FIG. 15B is a top section view of the roll-in cot of FIG. 15A, showing a corresponding position of a release assembly according to the present invention.

FIG. 15A shows the roll-in cot 60 engaging the rear of an emergency vehicle 85 such as an ambulance. The load wheels 72 that are disposed on the front of the frame 62 engage emergency vehicle 85. As similar with FIG. 2B, in the first position the handle 8 is shown in FIG. 15B in a neutral position as is the bar 69 and the pin 71 (FIG. 14).

Figure 16A:
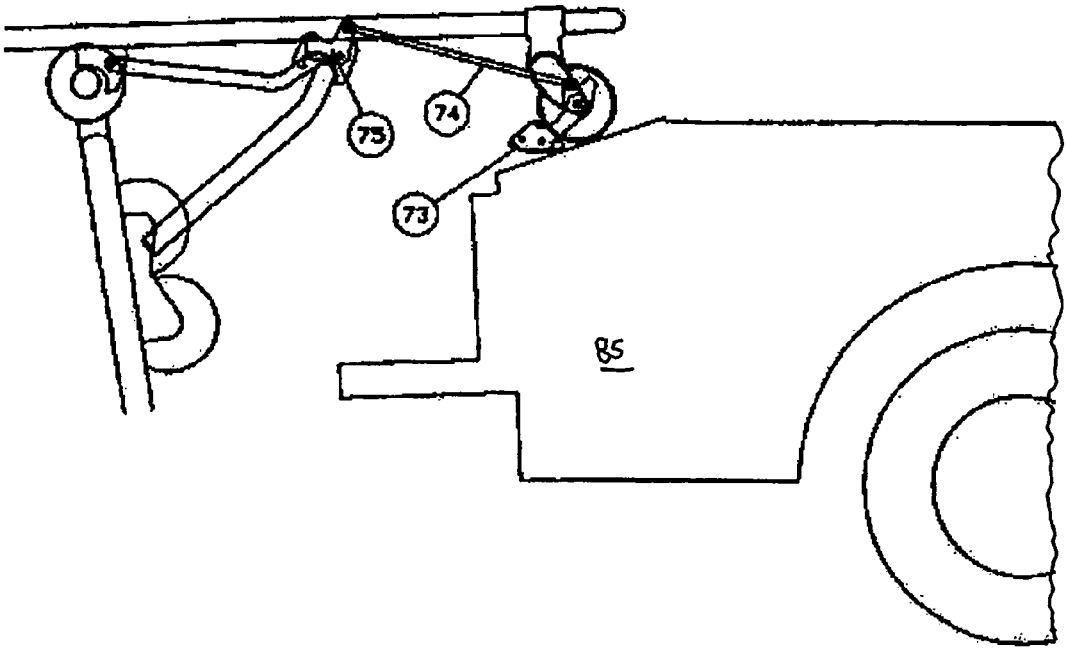
FIG. 16A is a side view of the roll-in cot of FIG. 14 in a second position.
Figure 16B:
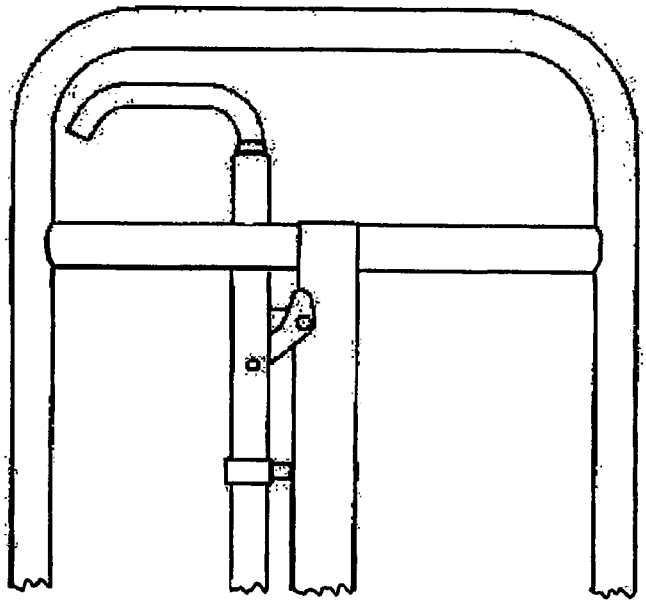
FIG. 16B is a top section view of the roll-in cot of FIG. 16A, showing a corresponding position of a release assembly according to the present invention.

In a second position shown in FIG. 16A, the load wheels 72 positioned at the front of frame 62 are further advanced onto the emergency vehicle 85. The load wheels 72 engage the emergency vehicle 85 and touch bar 73 is urged rearwardly, urging link rod 74 in a forward direction. Safety hook 75 is rotated in a clockwise direction and out of engagement with cross member 66. The position of the handle in FIG. 16B are the same as that shown in FIG. 15B.

Figure 17A:
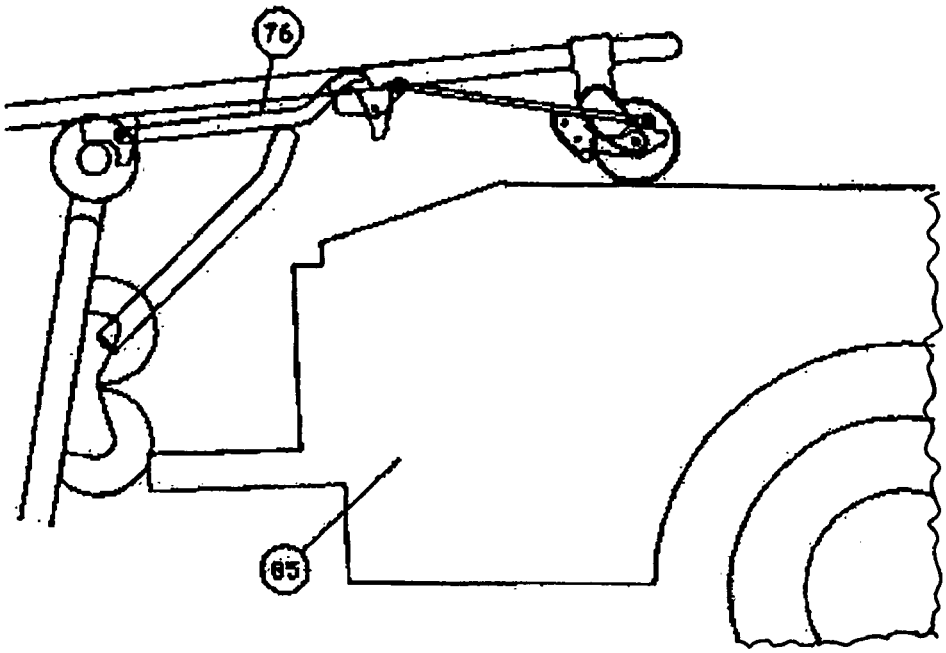
FIG. 17A is a side view of the roll-in cot of FIG. 14 in a third position.
Figure 17B:
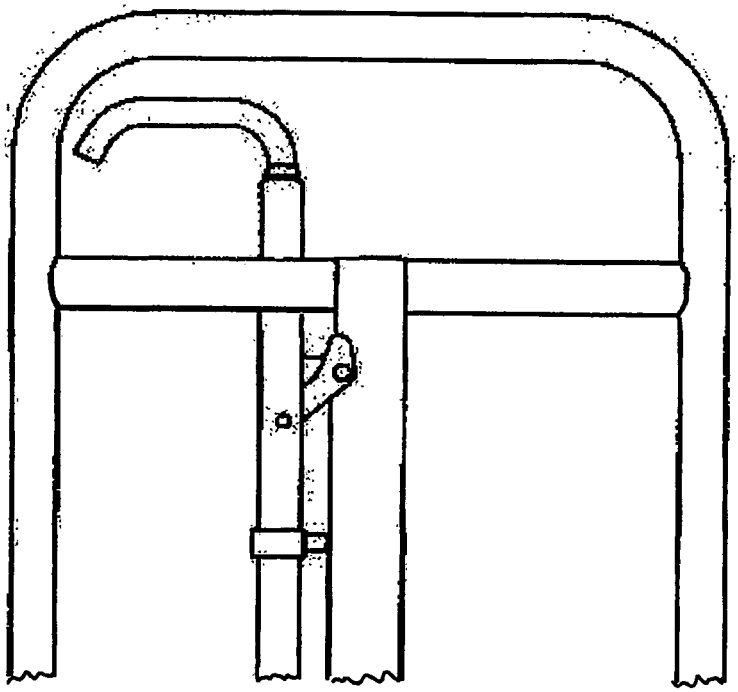
FIG. 17B is a top section view of the roll-in cot of FIG. 17A, showing a corresponding position of a release assembly according to the present invention.

In the third position shown in FIG. 17A left the arm 76 retains the safety hook 75 in a raised condition, thereby retaining the touch bar 73 in a raised condition of the emergency vehicle 85. The position of the handle in FIG. 17B are the same as that shown in FIG. 15B.

The operation of the trailing legs is similar to that shown in FIGS. 2A to 7B.

Persons skilled in the art will appreciate that the invention described above may be subject to improvements and modifications that will be apparent without departing from the spirit and scope of the invention described herein.

The invention claimed is:

1. A roll-in cot having a patient support attached to a wheeled transporter wherein the wheeled transporter comprises leading and trailing collapsible legs having respective proximal ends pivotally connected to a frame and distal ends including wheels wherein the trailing collapsible legs are operable from a locked condition by a release assembly comprising a safety and a leg release wherein said leg release comprises a handle connected to a pawl, wherein in an activated condition the pawl abuts a stop, said stop is disposed on the safety and is connected to a touch bar disposed in front of the trailing collapsible legs whereby engagement of the touch bar against platform withdraws the stop from abutment with the pawl and releases the trailing collapsible legs.

2. A roll-in cot having a patient support attached to a wheeled transporter wherein the wheeled transporter comprises leading and trailing collapsible legs having respective proximal ends pivotally connected to a frame and distal ends including wheels wherein the leading collapsible legs are operable from a locked condition by a release assembly comprising a leg release and a safety, the leg release comprises a handle connected to a pawl, wherein in an activated condition the pawl retains the leading collapsible legs in an erect condition and the safety is connected to a touch bar disposed adjacent load wheels whereby engagement of the touch bar against platform deactivates the safety wherein the release assembly requires both the leg release and the safety to be deactivated for the leading pair of collapsible legs to be collapsed.

3. A roll-in cot for loading onto a platform, said roll-in cot comprising:

a release assembly having a hand actuator, a leg release operably connected to the hand actuator, a linkage, and a touch bar operably connected to the linkage;

a frame providing a patient support; and leading and trailing collapsible legs having respective proximal ends pivotally connected to the frame and distal ends including wheels, wherein:

the touch bar is disposed in front of the trailing collapsible legs, the leg release is configured to permit release of the leading collapsible legs from a locked condition upon operation of the hand actuator, the linkage is configured to provide an activated condition which prevents the collapse of the trailing collapsible legs upon operation of the hand actuator, and the touch bar is configured to deactivate the activate condition of the linkage and enable the trailing collapsible legs to be collapsed upon engagement of the touch bar against the platform and operation of the hand actuator.

4. The roll-in cot according to claim 3, further comprising:

a second touch bar disposed in front of the leading collapsible legs; and a second linkage configured to provide an activated condition which prevents the collapse of the leading collapsible legs upon operation of the hand actuator, wherein the second touch bar is configured to deactivate the activate condition of the linkage and enable the leading collapsible legs to be collapsed upon engagement of the touch bar against the platform and operation of the hand actuator.

* * * * *